United States Patent [19]

Yamaguchi

[11] Patent Number: 4,805,548

[45] Date of Patent: Feb. 21, 1989

[54] MEANS OF CONNECTING A PUSHER BOAT AND A BARGE

[76] Inventor: Takuma Yamaguchi, 7-5-203, Sodegaura 2-chome, Narashino (Chiba-ken), Japan

[21] Appl. No.: 91,324

[22] PCT Filed: Apr. 7, 1982

[86] PCT No.: PCT/JP82/00108

§ 371 Date: Nov. 9, 1982

§ 102(e) Date: Nov. 9, 1982

[87] PCT Pub. No.: WO82/03610

PCT Pub. Date: Oct. 28, 1982

Related U.S. Application Data

[63] Continuation of Ser. No. 442,227, Nov. 9, 1982, abandoned.

[30] Foreign Application Priority Data

Apr. 10, 1981 [JP] Japan ..... 56-50907[U]

[51] Int. Cl.[4] ..... B63B 21/56

[52] U.S. Cl. ..... 114/248

[58] Field of Search ..... 114/74 A, 242, 248–251; 213/98, 149

[56] References Cited

U.S. PATENT DOCUMENTS 3,844,245 10/1974 Yamaguchi ..... 114/248
3,935,831 2/1976 Yamaguchi ..... 114/248
4,356,784 11/1982 Waters et al. ..... 114/248

*Primary Examiner*—Sherman D. Basinger
*Assistant Examiner*—Jesus D. Sotelo
*Attorney, Agent, or Firm*—McGlew and Tuttle

[57] ABSTRACT

A device for connecting a pusher boat to a barge the bow of the pusher boat is received in a notch formed in the stern portion of the barge, and axially movable connecting pins mounted on both sides of the bow of the pusher boat are inserted into vertical channels formed within the notch. A tooth on the rearward side of a helmet mounted at the outer end of each connecting pin engages with any one of several concavities formed on the rearward side wall of the channel on the corresponding side and an oblique flat forward face of the helmet may simultaneously come into contact with an oblique flat forward side wall of the channel. In this way the pusher boat and the barge are easily and firmly to each other.

3 Claims, 5 Drawing Sheets

MEANS OF CONNECTING A PUSHER BOAT AND A BARGE

This application is a continuation of application Ser. No. 442,227, filed Nov. 9, 1982, now abandoned.

BACKGROUND OF THE INVENTION

The present invention relates to a means of connecting a pusher boat and a barge.

Barges have long been employed for the transportation of bulky cargoes in rivers, canals, lakes and harbours, and even in open sea. There are two conventional methods to move the barges, one being to tow by a tug boat and the other being to push by a pusher boat. The present invention relates to the latter case where the barge is connected with the pusher boat to form a pusher-barge combination system. More particularly, the invention relates to a means of connecting a pusher boat and a barge to form an improved pusher-barge combination system with excellent performance.

The method of connecting the pusher boat and the barge by means of ropes has widely been employed. In this method, however, the stern portion of the barge comes into contact with the bow portion of the pusher boat, and the relative vertical sliding of said two portions cannot be avoided. This relative sliding of these two watercraft causes heavy wear and tear of the buffer means provided between them. In addition, owing to relative pitching and yawing motions between these two watercraft, the connecting ropes are very often subjected to undue and excessive tension, which may often cause breaking of ropes, and the difficulties in navigation of pusher-barge combination systems in a heavy seaway have principally been due to these disadvantages. And, furthermore, the heavy connecting ropes must be handled by crew and, accordingly, connection and disconnection works require heavy and dangerous muscular labour.

These disadvantages inevitably involved in the conventional rope-connected pusher-barge combination system were eliminated by the introduction of a new means of connection (hereinafter to be referred to as the "former invention") invented by the present applicant and patented in the United States under the U.S. Pat. No. 3,935,831 (corresponding Canadian Pat. No. 1,026,164, French Pat. No. 75/11118, German Federal Republic Pat. No. 25 16 372, Spanish Pat. No. 436,590 and U.K. Pat. No. 1,465,207), in which the stern portion of the barge is provided with a notch or well for receiving the bow portion of the pusher boat with a suitable clearance left around said bow portion, and each side of said notch is provided with a vertical channel open toward the notch and formed of a bottom wall and two side walls, the latter of which being placed adjacent to the opening or entrance of the channel and provided with horizontal concavities extending from the entrance of said notch to said bottom wall and stepwise arranged from the top to the bottom on said side walls in such a manner that the two concavities placed at a same height on the opposite side walls may form a pair of concavities. On the other hand, both sides of the bow portion of the pusher boat are provided with hydraulically operable connecting pins, respectively, which can rotate relative to said pusher boat. The outer free end of each of said connecting pins has two convexities on its forward and rearward sides, so shaped as to automatically select and tightly engage with one of said pairs of concavities when said connecting pin is hydraulically extended outwards so that its outer free end is forcibly inserted into said channel. Thus, said two watercraft are firmly connected by the engagement of said connecting pins and said vertical channels.

Another embodiment of the former invention comprises a helmet mounted on the spherical head of each of said hydraulically operable connecting pins. This helmet has, on its forward and rearward sides, two convexities which will engage with one of said pairs of concavities when said connecting pin is extended outwards to connect said pusher boat to said barge. Said helmet mounted on said spherical head can turn to any direction within a limited small range so as to absorb bad influence of inevitable geometrical inaccuracies of welded structures of hulls on which the components of the connecting means concerned are mounted.

Between the pusher boat and the barge connected with each other by thus constructed connecting means of the former invention, there exists the relative pitching motion only and other relative motions such as rolling, yawing, heaving, drifting and surging are not permitted, and, as the result, the seaworthiness of the pusher-barge combination system can be remarkably improved as compared with the conventional rope-connected one.

The application in practice of the connecting means of the former invention has proved a remarkably high seaworthiness in high sea, while some disadvantages were disclosed particularly in the course of connection work. For inserting said connecting pins into said vertical channels, respectively, for the purpose of connection, the fore-and-aft positions of the axes of said connecting pins must be in coincidence with those of the centrelines of said vertical channels. Before being connected with each other, however, these two watercraft are floating freely and, in most cases, more or less oscillating freely independent of each other. Accordingly, it is practically impossible to keep said axes in coincidence with said centreline. Such a coincidence can be obtained and kept by means of an additional means of relative positioning according to Japanese Pat. No. 1,022,178 of the present applicant. Even with this means of relative positioning, it is not so easy to keep an accurate coincidence of positions for a certain long time necessary for connection, particularly when two watercraft are more or less oscillated by waves.

Another disadvantage is the abrupt turn of the connecting pin in the course of its extension for connection, when two watercraft are somewhat oscillated by waves. The outer free end of the connecting pin or the helmet mounted thereon is, when looked at from above, tapered toward its outer end, and the vertical channel of the barge has, when looked at from above, likewise has a trapezoidal shape, in its horizontal cross-section, wider at the entrance and narrower at the bottom for easily receiving the tapered end of said connecting pin or the tapered helmet. Two oblique side walls of the vertical trapezoidal channel, which correspond to the forward and rearward side walls of said channel in respect to the barge itself, are provided with concavities stepwise arranged from their upper ends to lower ends. The portion between two adjoining concavities forms a tooth-shaped convexity or swell. Accordingly, when the pusher boat is so small that it cannot stand still in inevitable small waves, or when the stern of the pusher boat is deviated to the port or starboard side by side or oblique waves so that the coincidence of the centrelines of two watercraft to be connected cannot be maintained, it may happen, though for a short time, that the outer free end of the connecting pin or the helmet mounted thereon may approach the forward or rearward side wall and, as the result, one of the two convexities on the forward and rearward sides of the pin or the helmet may enter one of the concavities on the corresponding side wall of the vertical channel and the other convexity may not enter any of the concavities on the opposite side wall. If the pusher boat is moved vertically by a wave at this moment, the convexity on the connecting pin or helmet which has already entered the corresponding concavity will be hit up or down by the swell adjacent to said concavity and, as the result, the connecting pin or the helmet will be turned. After this, the two convexities on the connecting pin or the helmet cannot enter their corresponding pair of concavities even when the connecting pin is further extended out and connection becomes impossible. Under such a circumstance, the connecting pins must once be retracted, the angular position of the turned connecting pin or the helmet rectified and connection tried again. When the oscillation of the pusher boat cannot be stopped because of incessantly coming waves, such a repeated trial may not assure any immediate connection in good order and an important delay of departure may occur. If the pusher boat must operate a number of barges alternately in a short service route, regular sailing schedule cannot be maintained because of frequent delay of departure. Similar accidental turn of the connecting pin or the helmet can take place even in the course of retraction for disconnection. The present invention is proposed in order to solve the above-mentioned problems involved in the connecting means of the former invention.

SUMMARY OF THE INVENTION

The principal object of the present invention is to provide, without sacrificing the high seaworthiness already realized by the connecting means of the former invention, an improved means of connecting a pusher boat and a barge in which the relative fore-and-aft positions of the pusher boat and the barge can be automatically adjusted in the course of extension of the connecting pins for connection and, further, each connecting pin with helmet mounted thereon will easily enter and engage with the appropriate concavity in the vertical channel of the corresponding side without turning even when two watercraft are being oscillated by waves.

Pursuant to the above-mentioned objects of the invention, the means of connecting a pusher boat and a barge is constructed as follows: that is, the stern portion of the barge is provided with a notch or well, into which the bow portion of the push boat can be received with some suitable clearance being left around said bow portion. Each side of said notch is provided with a vertical channel open toward the notch and composed of a flat bottom wall, an oblique flat forward side wall and a rearward side wall having horizontal concavities extending from the entrance of said channel to said bottom wall thereof and stepwise arranged from top to bottom. On the other hand, both sides of the bow portion of the pusher boat are provided with hydraulically operable connecting pins, respectively, which can rotate relative to said pusher boat. The outer free end of each of said connecting pins has a spherical head, over which a helmet is tightly mounted in such a manner as to be able to turn, relative to said connecting pin, to any direction within a limited small range necessary in the practical application, except that the turn relative to the connecting pin about its axis is not permitted. Said helmet has a vertical oblique forward face corresponding to the forward side wall of said channel and a tooth on the rearward side so shaped as to automatically select and tightly engage with one of said concavities on said rearward side wall of said channel when said connecting pin is hydraulically extended to insert said helmet forcibly into said channel. Thus, said two watercraft can be firmly connected by the engagement of said helmet mounted on said connecting pin and said vertical channel.

The spherical mounting of said helmet can accommodate said helmet to inevitable geometrical inaccuracies due to welding of the structures, on which the components of the connecting means of the present invention are mounted, and realize a very firm and reliable connection without any undue stresses arising in any portion of the means of connection. Further, between the pusher boat and the barge connected with each other by thus constructed connecting means, there exists relative pitching motion only and other relative motions cannot occur. Accordingly, similar to the case of the former invention, the motion of thus connected pusher-barge combination system is very gentle. Still further, the concavities in said channels are stepwise arranged from top to bottom to cover the whole range of variation of the draught relationship and, accordingly, firm connection due to engagement of said teeth of said helmets mounted on said connecting pins and said concavities at the existing corresponding height can be readily formed in any probable draught relationship.

When connecting the pusher boat to the barge, what is needed is only to extend the connecting pins simply by hydraulic power, immediately after the fender at the bow end of the pusher boat has come into contact with the deepest point of the notch of the barge. Then, the forward faces of the helmets mounted on the properly positioned connecting pins will first come into contact with the forward side walls of the channels of the barge and then will slide on the latter walls as said connecting pins are gradually extended until the teeth of the helmets will come into contact with appropriate concavities to realize a firm and perfect engagement of the helmets and the channels by forced tight contact at three surfaces, on each side respectively, i.e., the forward face and the upper and lower surfaces of tooth on rearward side of each helmet. Thus, the configurations of the helmets and the channels of the present invention involve an important function and role of determination of relative fore-and-aft positions of the pusher boat and the barge. In addition, said configurations of the helmets and the channels can realize such a very important advantage that such undue turn of the connecting pins with their mounted helmets as may often occur due to oscillation of the pusher boat and/or the barge by waves in the course of their extension for connection can be automatically corrected in the latter half of the same course of extension to realize a perfect engagement of the helmets and the channels as will be explained in details in the following. In other words, the configurations of said helmets and said channels of the present invention can remarkably assure a very stable connection work and, if slightly assisted additionally by the thrust of the propulsion means of the pusher boat, this merit is even doubled.

Thus, the connecting means of the present invention can eliminate the two weak points of the connecting means of the former invention without sacrificing the high seaworthiness already realized by said former invention, and can remarkably improve the convenience in its practical use.

Other and further objects and features of the invention will become more apparent upon the understanding of the illustrative embodiment about to be described or will be indicated in the appended claims in connection with the accompanying drawings.

DETAILED DESCRIPTION OF THE PREFERRED EMBODIMENT

Figure 1:
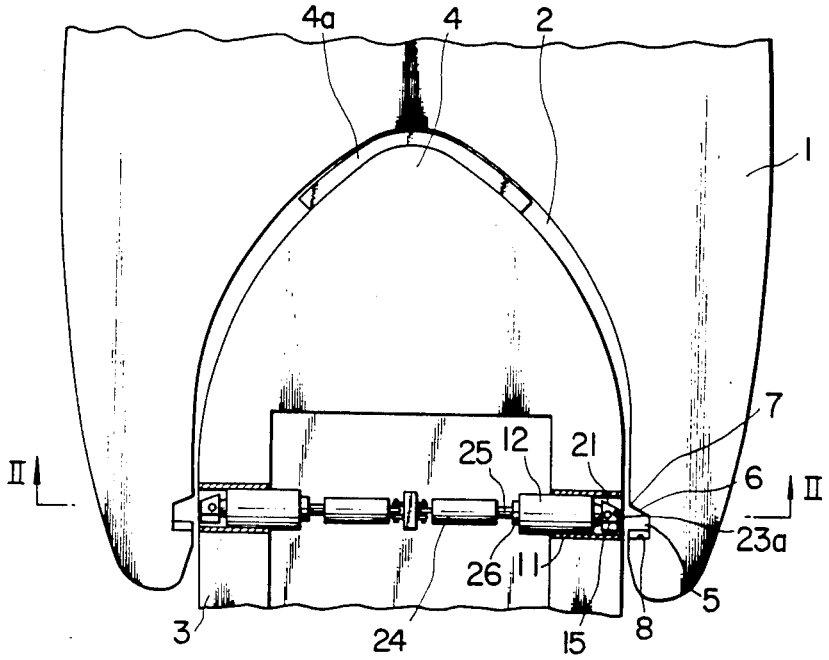
FIG. 1 is a partial cross-sectional plan view of an embodiment of the present invention before connection.
Figure 2:
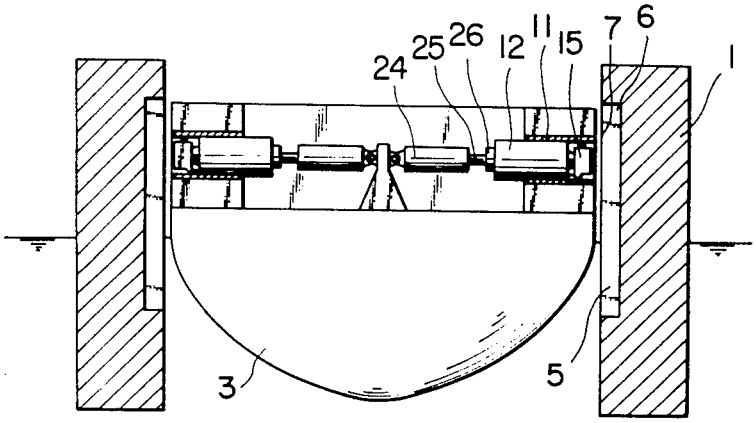
FIG. 2 is a cross-sectional elevational view of said embodiment taken along the line II—II in FIG. 1.

Referring to FIGS. 1 to 7, the barge 1 is provided with a notch or well 2 at its stern or rear portion of receiving the bow 4 of the pusher boat 3. The configuration and size of the notch 2 is such that, when the pusher boat 3 is connected to the barge 1, a proper clearance may be left between the bow 4 of said pusher boat 3 and the notch 2 of the barge 1. Each side wall of the notch 2 is provided with a vertically extending channel 5 open toward the inside of the notch 2 and having a horizontal cross-section with enlarged width toward the entrance open to said notch 2, preferably a trapezoidal cross-section as shown in FIGS. 1, 3, 4 and 6. The oblique forward side wall 6 of the channel 5 corresponding to the fore of the barge 1 is a vertical flat surface having such an angle to the horizontal centerline of the barge 1 as to permit the forward face of the helmet mounted at the outer end of the connecting pin to slide on the forward side wall 6 while the helmet is being inserted into the channel 5, after the outer end of the forward face of the helmet has come into contact with the forward side wall 6 at a point near its entrance end 7 while the connecting pin of the pusher boat is extended out for connection. The rearward side wall 8 of the channel 5 corresponding to the stern of the barge 1 has concavities 9, 9', 9'', . . . having a same shape in the vertical cross-section, which are horizontally extending from the entrance of said channel 5 to its bottom wall and stepwise arranged from top to bottom approximately at an equidistance apart. The rearward side wall 8 having concavities 9, 9', 9'', . . . may have a certain angle to the transverse horizontal axis of the barge 1 or may be approximately parallel to the same axis, i.e., approximately perpendicular to the longitudinal horizontal axis of said barge 1. The accompanying figures shown the latter configuration, where the rearward side wall 8 is approximately perpendicular to the horizontal longitudinal axis of said barge 1. The vertical channel 5 having a vertical flat forward side wall 6 and a rearward side wall 8 with a series of concavities 9, 9', 9'', . . . forms a tooth-engagement portion for receiving and fixing, at any vertical position corresponding to the existing draught relationship of the two watercraft, the helmet mounted on the outer end of the connecting pin extended out from each side of said bow 4 of said pusher boat 3, which will be explained further hereinafter.

Each side of said bow 4 of said pusher boat 3 is provided with a cylindrical connecting pin 12 which is supported by and slides along a long bearing 11 transversely placed symmetrically with respect to the ship's centerline and fixed to the hull. The outer end portion of said connecting pin 12 is shaped as a spherical head 14 with a contracted neck portion 13, and a helmet 15 with concaved spherical inner surface is mounted over the spherical head 14 so as to fit on the latter with a least clearance. The spherical inner surface of said helmet 15 is partly formed, in the opening portion where the spherical head portion of said connecting pin 12 enters therein, of a split gland 16 fixed to the helmet 15 by bolts (not shown in drawings). Said gland 16 has an opening or collar 17 of a diameter greater than that of said neck portion 13 and smaller than that of the spherical head 14 so that the helmet 15 can turn about the vertical and horizontal axes and also in any direction defined as a combination of these two kinds of turn within the range limited by the correlation of diameters of the neck portion 13 and the opening 17. Further, the spherical head 14 has, at its top portion, a shallow long groove 18 to receive the lower end of a vertical pin 20 placed in and supported by a vertical hole 19 at the top portion of the helmet 15 so that relative turn of said connecting pin 12 and the helmet 15 about the axis of the connecting pin 12 may be prevented. Accordingly, when relative pitching of the pusher boat 3 and the barge 1 occurs during connected navigation as may be explained in the following, the connecting pin 12 and the helmet 15 will turn simultaneously in a same angle.

Figure 8:
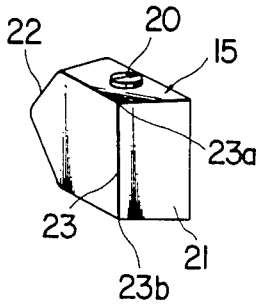
FIG. 8 is a perspective view of the helmet of the present invention.
Figure 9:
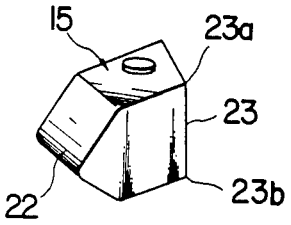
FIG. 9 is another perspective view of said helmet.

The helmet 15 is generally of a trapezoidal shape in the plan view. Its forward face 21 facing to the fore of the pusher boat 3 is a vertical surface corresponding to an oblique side of the trapezoid, and its angle to the axis of the connecting pin 12 is equal to the angle of the forward side wall 6 of said channel 5 to the transverse horizontal axis of the barge 1. The rearward portion of the helmet 15 is, as is shown in the cross-sectional elevational view of FIG. 7, formed as a horizontally extending tooth 22 which can come into contact with any of the concavities 9, 9', 9'', . . . on said rearward side wall 8 of the channel 5, when the helmet 15 has engaged into the channel 5 and the forward face 21 has come into tight contact with the forward side wall 6. As is clear from FIGS. 7, 8 and 9, the helmet 15 has, in the cross-sectional elevational view, approximately a pentagonal shape composed of the forward face 21, the upper and lower inclined surfaces forming the tooth 22, the upper surface at the top and the lower surface at the bottom, and the outer end side 23 forming the outboard end of the forward face 21 is extended from its upper end 23*a* to its lower end 23*b*. The helmet 15 is supported and kept at its horizontal position by a coil spring 27 when the present connecting means is not in use.

Figure 3:
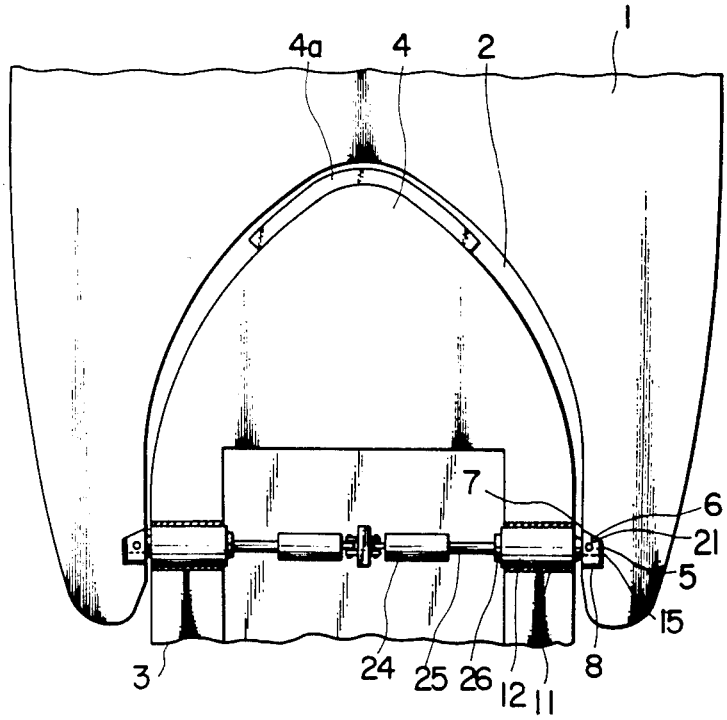
FIG. 3 is a partial cross-sectional plan view of said embodiment after connection.
Figure 4:
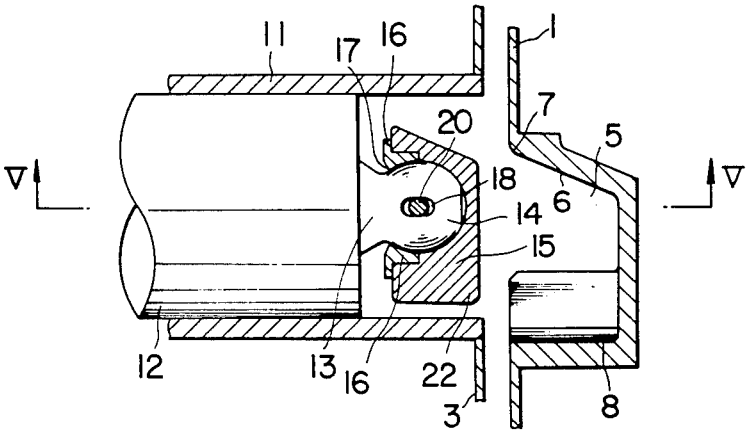
FIG. 4 is a partial cross-sectional plan view showing details of important parts of said embodiment before connection.
Figure 5:
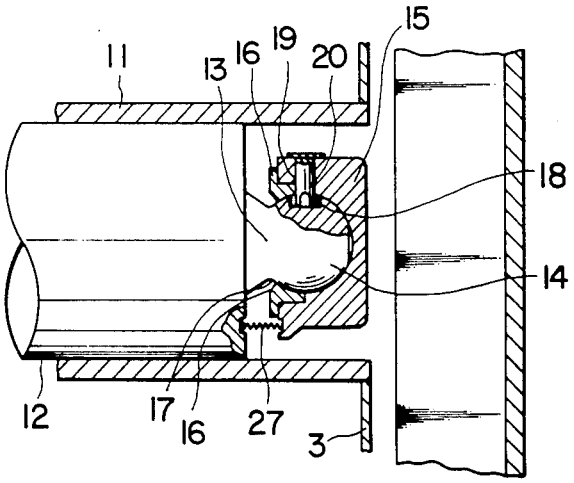
FIG. 5 is a partial cross-sectional elevational view showing details taken along the line V—V in FIG. 4.
Figure 6:
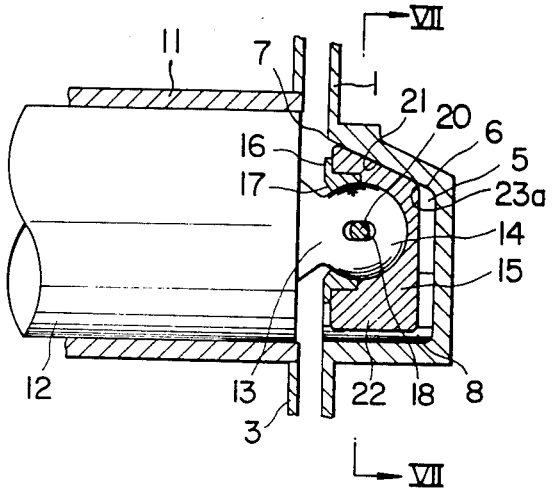
FIG. 6 is a partial cross-sectional plan view showing details of important parts of said embodiment after connection.
Figure 7:
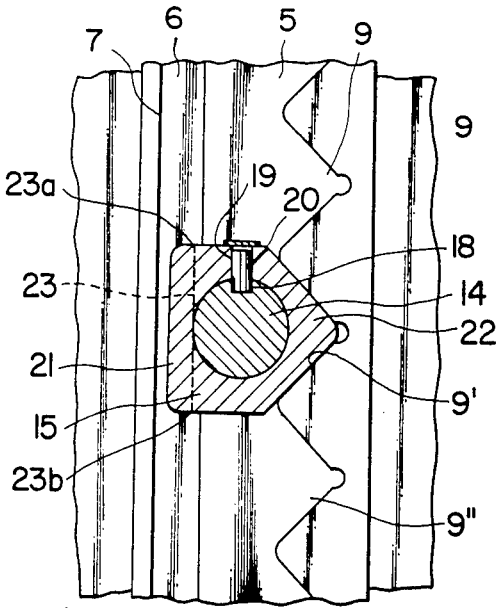
FIG. 7 is a partial cross-sectional elevational view showing details taken along the line VII—VII in FIG. 6.
Figure 10:
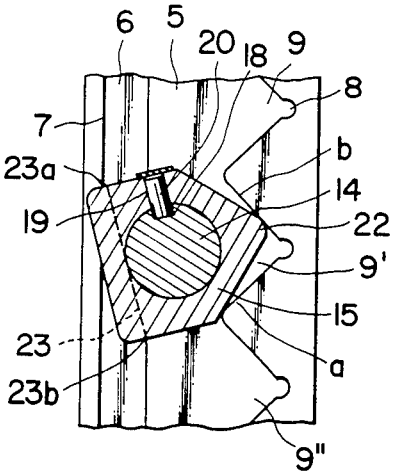
FIG. 10 is a partial cross-sectional elevational view showing the positional relationship between the vertical channel with concavities and the helmet, of the present invention, at a partially turned position of the latter.

When connecting the pusher boat 3 to the barge 1, the connecting pin 12 on each side of the pusher boat 3 is extended out to insert the helmet 15 into the channel 5 of the barge 1. If, at the stage that the tooth 22 has slightly entered one of the concavities 9, 9′, 9″, . . . (concavity 9′ in FIG. 10), the lower face of the tooth 22 is hit upward by the swell "a" forming the lower contour of the concavity 9′, owing to the vertical oscillation of the pusher 3 or the barge 1, the helmet 15 will turn, together with the connecting pin 12, about the axis of the connecting pin 12. Next moment, the upper end 23*a* of the outer end side 23 of the forward face 21 of the helmet 15 will come into contact with the forward side wall 6 so that only the turn of the helmet 15 about the upper end 23*a* of the outer end side 23 may be permitted. Under these circumstances, the tooth 22 is obliged to enter more deeply into the same concavity 9′ adjacent to the swell "a" so that the tip of the tooth 22 will come into contact with the swell "b" forming the upper contour of the concavity 9′ to interrupt further turn of the helmet 15. In this case, the connecting pin 12 turns together with the helmet 15 mounted thereon. As the connecting pin 12 is forcibly extended further, the helmet 15 will be guided by the surfaces of the lower and upper swells "a" and "b" forming the concavity 9′ to proceed further toward the bottom of said channel 5. In the course of this insertion, the angle of turn of the helmet 15 will be gradually decreased as the width of the channel 5 becomes narrower, until the upper and lower surfaces of the tooth 22 come into contact with the upper and lower surfaces of the concavity 9′ at the same time as the forward face 21 of the helmet 15 comes into tight contact with the forward side wall 6 of the channel 5 and the motion of the connecting pin 12, together with the helmet 15, is stopped as shown in FIGS. 3, 6 and 7. As may be clear from the above explanations, once the tooth 22 of the helmet 15 has entered one of the concavities 9, 9′, 9″, . . . of the channel 5, the combination of the helmet and the channel having the configurations of the present invention can correct automatically the transient turn of the connecting pin 12 due to oscillation of the pusher boat 3 and/or the barge 1 to realize finally a perfect connection. The inboard end of said connecting pin 12 is connected with the power transmitting piece of a hydraulic power means installed on the hull of said pusher boat 3, such as the piston rod 25 of a hydraulic cylinder 24, by means of a proper coupling member 26 which permits free relative rotational motions, whereby relative pitching of two watercraft connected with each other can be permitted without causing any trouble or disorder. The connecting pin 12 with the helmet 15 mounted thereon is extended out and retracted in by the function of the hydraulic power means, such as the hydraulic cylinder 24, to be energized by pressure fluid supplied by a hydraulic power source (not shown in drawings) on board. After the outward motion of the connecting pin 12 for connection has been stopped, the outward force of the hydraulic power means, such as the hydraulic cylinder 24, is kept by pressure fluid supplied through a non-return valve (not shown in drawings) from a pump, a pressure accumulator or the like (not shown in drawings). Thus, the connecting pin 12 is forcibly kept at its extended position, and the non-return valve will prevent inward motion of the connecting pin 12 subjected to large external force which, otherwise, would push back said connecting pin 12 and loosen connection.

Besides the hydraulic cylinder 24 shown in accompanying drawings, the hydraulic power means for operating the connecting pin 12 may be of other designs, such as a combination of a rotary hydraulic motor and a screw-threaded rod or the like.

Next, the functions and operations of the connecting means according to the embodiment described above will be explained in the following. Before connection, the connecting pin 12 is retracted in the bearing 11 as shown in FIGS. 1, 2, 4 and 5, or, in other words, it is retracted in the hull of the pusher boat 3. The bow 4 of said pusher boat 3 is ordinarily provided with a soft fender 4*a* for protecting the bow 4. The relative positions of the connecting pin 12 and the channel 5 are so determined that, when the fender 4*a* is in contact with the deepest point of the notch 2, the outer end side 23 of the forward face 21 of the helmet 15 may be located slightly abaft the entrance end 7 of the forward side wall 6 of the channel 5. Then, the hydraulic cylinder 24 is actuated to push out the connecting pin 12, whereby the forward face 21 of the helmet 15 comes into contact with the forward side wall 6 of the channel 5 and then, as the connecting pin 12 is further extended out, the forward face 21 of the helmet 15 will slide on the forward side wall 6 to allow the helmet 15 to be inserted into the channel 5, while the pusher boat 3 is being pushed back by a distance corresponding to the inclination of the forward side wall to the transverse horizontal axis of the barge 1. In the meanwhile, the tooth 22 of the helmet 15 will select, automatically, and enter one of the concavities 9, 9′, 9″, . . . which is approximately at the same height as said connecting pin 12 (concavity 9′ in the example shown in drawings), until the upper and lower surfaces of the tooth 22 come into simultaneous tight contact with the upper and lower surfaces of the automatically selected concavity (concavity 9′ in the example shown in drawings), respectively, and the motion of the connecting pin 12 is stopped. At this stage of function, the upper and lower surfaces of the tooth 22 of the helmet 15 is in tight contact with the upper and lower surfaces of the selected concavity, respectively, and, at the same time, the forward face 21 is also in tight contact with the forward side wall 6 of the channel 5, so that the helmet 15 is in perfect engagement with the selected concavity. Then, the pressure in the hydraulic cylinder 24 is kept as it is by a pump, a pressure accumulator or the like and, thus, the connection work is completed as shown in FIGS. 3, 6 and 7. Even if the connecting pin 12, together with its mounted helmet 15, is turned by the influence of waves in the course of insertion of the helmet 15 into one of the concavities 9, 9′, 9″, . . . , such an angle of turn will be gradually eliminated automatically as the helmet will proceed into the selected concavity so that a perfect engagement will be attained. Further, the concavities 9, 9′, 9″, . . . are stepwise arranged vertically over a necessary range corresponding to the variation of draught relationship, and the tooth 22 of the helmet 15 can automatically select and enter, depending on the existing draught relationship, any one concavity which is placed at the same height as the connecting pin 12, or the tooth 22. Accordingly, any adjustment of draught relationship is not needed before connection. For connection, the connecting pin is to be simply extended immediately after a very simple maneuver to insert the bow 4 of the pusher boat 3 into the notch 2 of the barge 1 until the fender 4*a* comes into contact with the deepest point of the notch 2, so that the pusher boat 3 may be pushed back as the result of the special configurations of the helmet and the channel to keep a proper clearance between these two watercraft after connection. In addition, when these watercraft are more or less oscillated by waves, small ahead thrust may be maintained by the propulsion means of the pusher boat 3 even after the fender 4a has come into contact with the deepest point of the notch 2 of the barge 1, so that the forward face 21 of the helmet 15 may be forcibly pressed onto the oblique forward side wall 6 of the channel 5 while the former slides on the latter to reduce remarkably the possibility of turning of the connecting pin 12 due to oscillation of the watercraft and, thus, assure a very stable connection work.

Nowadays, almost all ships are constructed by welding and, accordingly, dimensional and angular inaccuracies due to deformations caused by welding are inevitable. For example, when the channel 5 together with concavities 9, 9', 9'', . . . is made of cast steel and welded onto the hull of the barge 1, it is nearly impossible to fix this cast steel piece with full angular accuracy. In the connecting means of the present invention, however, the helmet 15, which will come into direct tight contact with the channel 5, is so mounted on the spherical head 14 as to permit slight change of its direction within a limited range necessary for this self-adjustment and, accordingly, even when there are some angular errors due to welding in fixing the components of the coupling means or there is a slight misalignment between two connecting pins 12 on the port and starboard sides, the helmet 15 will automatically change its angular position slightly to accommodate itself to the existing inaccuracy so that it may come into tight contact with said channel 5 perfectly and maintain an ideal connection.

While only a preferred embodiment of this invention has been shown and described by way of illustration, various midifications may occur to those skilled in the art and it is, therefore, desired that it be understood that it is intended in the appended claims to cover all such modifications as fall within the true spirit and scope of this invention.

What is claimed is:

1. Apparatus for connecting a pusher boat and a barge, said barge having a notch formed in the stern portion of said barge, said notch shaped to receive a bow portion of said pusher boat which has a bow fender mounted at the front thereof, said barge having two vertically elongated channels facing each other transversely of a centerline of said barge and so formed within the side walls of said notch as to have a greater clear width at their entrances at said side walls than at their bottoms, and said pusher boat having, on both sides of said bow portion, two transversely elongated connecting pins arranged to be axially extended and retracted by the function of hydraulic power means and having helmets mounted at their outer ends and shaped to engage with said channels, wherein:

(a) the forward side walls of said channels, which correspond to the fore of said barge, are formed as oblique flat vertical walls;

(b) the rearward side walls opposite to said forward side walls of said channels have concavities of a same shape stepwise arranged from top to bottom at an approximate equidistance apart and horizontally extending from the entrances to the bottoms of said channels;

(c) each of said helmets is mounted on either of said connecting pins in such a manner that relative turn of said helmet and said connecting pin about the axis of said connecting pin cannot take place and relative turns in other directions can be permitted within a small limited range;

(d) the forward faces of said helmets are oblique flat surfaces corresponding to said oblique forward side walls of said channels, while the rearward sides of said helmets are teeth which can tightly engage with said concavities of said channels; and (e) the outer end sides of said forward faces of said helmets are located slightly abaft the entrance ends of said forward side walls of said channels when the bow fender of said pusher boat comes into contact with the deepest point of said notch of said barge.

2. Apparatus according to claim 1, wherein said helmets are pentagonal in vertical cross-sectional shape with said teeth and said concavities each are triangular in vertical cross-sectional shape.

3. An apparatus for connecting a pusher boat having a bow portion and a pusher boat centerline and a barge having a barge centerline and a back end comprising: notch means associated with the back end of the barge for positioning the pusher boat in a first aligned position; two vertically elongated channels formed facing each other on opposite side portions of said notch, each of said channels having a rear planar face substantially parallel to said barge centerline and each of said channels having a planar entrance end face forming an angle greater than 90° with said rear planar face and each of said channels having a rearward side wall substantially perpendicular to said barge centerline, said rearward side wall having concavities of a same shape stepwise arranged from top to bottom at an approximate equidistance apart extending from an upper end of said channel to a lower end of said channel; two transversely elongated connecting pins arranged on said pusher boat on both sides of said bow portion extending in a direction perpendicular to said pusher boat centerline, said connecting pins being connected to hydraulic power means for axially extending and retracting the connecting pins; helmets for engagement with said channels, each helmet mounted on an outer end of a connecting pin, said helmet being pentagonal in cross-section taken parallel to said pusher boat centerline with a toothed portion for engaging one of the concavities, said helmet having a first substantially planar face forming a cam means and a second substantially planar face, said helmet first substantially planar face being substantially parallel to said planar entrance end face when said pusher boat is in said first aligned position and said helmet second planar face being substantially parallel to said rear planar face when said pusher boat is in said first aligned position; pivot means connected between each of said connecting pins and each of said helmets including spring means to maintain said tooth portion in a substantially horizontal position and to urge said tooth portion into a horizontal position upon said tooth portion being deflected into a position which is other than horizontal; bow fender means cooperating with said notch means to position said pusher boat in said first aligned position; said first aligned position placing said helmets and associated connecting pins slightly forward of a position in which said helmet tooth may engage said concavities, said pins when extended in the direction of said channels, when said pusher boat is in said first aligned position, causing said cam means to engage a cam surface of said entrance end face urging said pusher boat into a second aligned position in which said helmet engages said channels such that said tooth portion enters one of the concavities of said channel such that upper and lower surfaces of the tooth portion come into simultaneous contact with upper and lower surfaces of said one of said concavities.

* * * * *